United States Patent [19]

Nakayama

[11] Patent Number: 4,718,642

[45] Date of Patent: Jan. 12, 1988

[54] WIRE LATTICEWORK AND FENCE OF WIRE LATTICEWORK

[75] Inventor: Kiyoshi Nakayama, Takamatsu, Japan

[73] Assignee: Asahi Steel Industry Co., Ltd., Japan

[21] Appl. No.: 881,129

[22] Filed: Jul. 2, 1986

[51] Int. Cl.[4] ..... E04H 17/16

[52] U.S. Cl. ..... 256/24; 256/23; 256/73; 52/654

[58] Field of Search ..... 256/33, 32, 47, 24, 256/23, 73; 52/654

[56] References Cited

U.S. PATENT DOCUMENTS

| | | | |
|---|---|---|---|
| 760,167 | 5/1904 | Warner | 52/654 X |
| 767,533 | 8/1904 | Warner | 52/654 |
| 2,996,285 | 8/1961 | Johnson | 256/47 |
| 3,089,681 | 5/1963 | Smithwick | 256/47 |
| 4,558,851 | 12/1985 | Nakayama | 256/23 X |

FOREIGN PATENT DOCUMENTS

| | | | |
|---|---|---|---|
| 1032475 | 6/1966 | United Kingdom | 256/33 |

*Primary Examiner*—Andrew V. Kundrat

*Attorney, Agent, or Firm*—Henry C. Nields

[57] ABSTRACT

Wire latticework for a fence composed of vertical wire members and horizontal wire members. The latticework is formed at least at its upper with a cylindrical part which are provided by forming the end portions of the vertical wire members and the horizontal wire members thereon.

22 Claims, 22 Drawing Figures

WIRE LATTICEWORK AND FENCE OF WIRE LATTICEWORK

BACKGROUND OF THE INVENTION

1. Field of the Invention

The invention relates to a wire latticework and a fence of the wire latticework. The wire latticework is made by a plurality of wire members which are combined lengthwise and widthwise by weldments or the like, and the fence of which includes the supports thereof.

In a conventional fence, the wire latticework is held at its top and the bottom with a pipe beam. However, since the beam is heavy in weight and is subject to the wind pressure or snow weight in comparison with the lattice, it cause bad influence to strength over the whole structure of the fence. The beams obstruct the view while the lattice part is perspective. Further, the fence using the beam is expensive because the beam is made of much iron, and because a joining work of the beam and the lattice is not easy.

To overcome the said disadvantages with the conventional fence, the inventor of the present invention already proposed new fence of the wire latticework in U.S Pat. No. 4,558,851. The wire latticework utilized in the proposed invention is circled at least at the top end or the top and the bottom ends, where the horizontal wire members are fixed to form a cylindrical portion which substitutes for the beam.

2. Summary of the Invention

A object of the invention is to improve the said proposed invention, especially to strengthen a wire latticework.

A second object of the invention is to provide a light fence of the the wire latticework;

A third object of the invention is to provide a fence of the wire latticework which is resistant against corrosion;

A fourth object of the invention is to provide a fence of the wire latticework which save the materials and is easy in setting up and totally economical;

A further object of the invention is to provide a fence of the wire latticework which is harmonized in appearance.

The the wire latticework of the present invention includes some horizontal wire members which are thick in a diameter. The horizontal wire member(s) being thick in diameter should be set at the portion where the strength is required. Due to the horizontal wire member(s) being thick in a diameter, the thickness in a diameter of the other horizontal wire members can be reduced, which make the wire latticework light in weight keeping strength thereof.

The the wire latticework of the present invention include a closed circle portion at least at the top end or the top and bottom ends of the vertical wire member. The top of the closed circle abuts and is fixed by weld or the like to the base thereof. Such structure make the the wire latticework, especially the cylindrical part strong.

Further the fence of the present invention include the support which comprises vertical wire members and plates. Such support made of the wire members is less resistant against the windpressure or the snow weight, which strengthen the whole of the fence. And also the support is resistant against corrosion. Further such combination of the support and the the wire latticework improves a harmony in the outlooking.

More important advantage of the invention is that the the wire latticework and the support with the wire members can be joined with more simple joining means. Namely the more simple joint can be employed to join the vertical wire member of the the wire latticework and the vertical wire member of the support compared with joining the vertical members with the pipe of the conventional support.

DETAILED DESCRIPTION OF THE PREFERRED EMBODIMENTS

Figure 1:
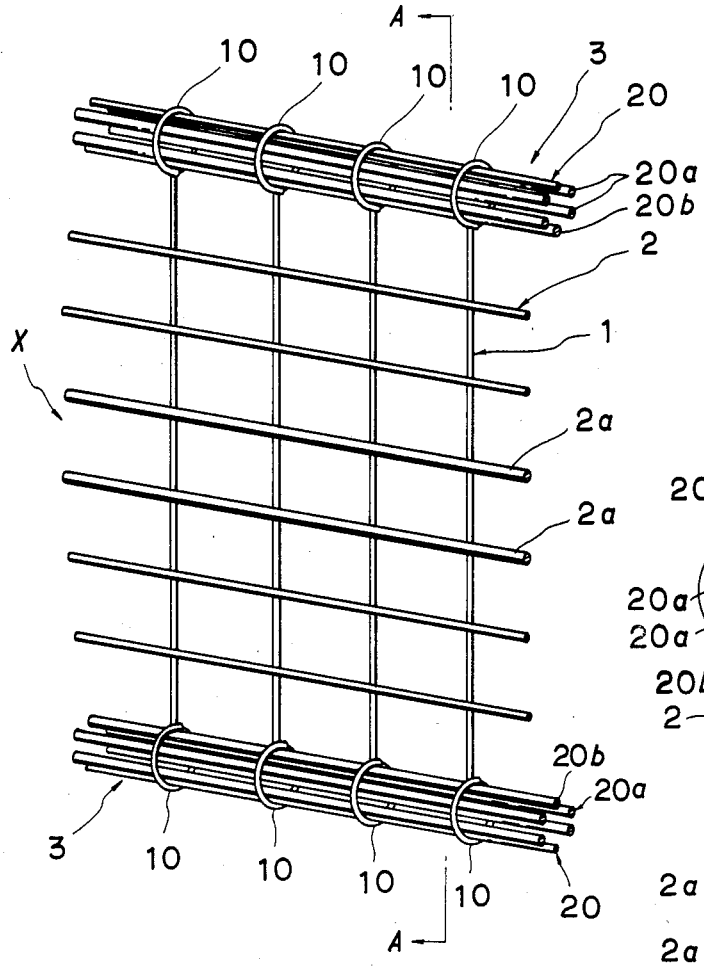
FIG. 1 is a perspective view showing one embodiment of the wire latticework according to the invention.

In FIG. 1, 1 is the vertical wire members, 2 is the horizontal wire members 2, which are so fixed each other at the right angle by the welding or the like as to form the wire lattice body X.

the vertical wire members 1 is bent at least at the upper end and forms the circle 10. In the embodiment the circle 10 is formed at the lower end too. The vertical wire members 20 is also set in the circle 10 in order to form the cylindrical part 3. The sectional center C of the cylindrical part 3 is preferably set on the line produced from the plane part of the wire lattice body X in view of the strength and the outlooking of the wire lattice body X.

Figure 2:
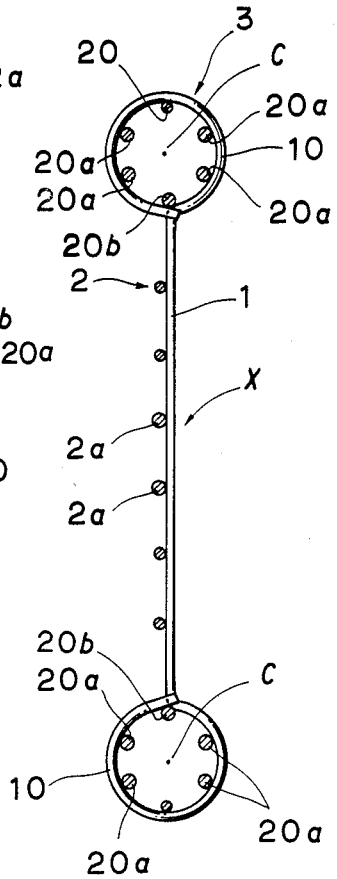
FIG. 2 is a cross sectional view seen from A—A line in FIG. 1.

In the invention some of the horizontal wire members 2 is thicker in diameter than the others. In other words, some of the horizontal wire members 2 is thinner in diameter than the others. This construction provides the strength of the wire lattice body X, keeping the weight light and saving the material of the wire members. It may be decided responding to the strength required and the environment, which and how the horizontal wire members 2 should be thicker in diameter. In the embodiment of FIG. 1 and FIG. 2, the horizontal wire members **20*a* set in both sides of the cylindrical part 3 and the horizontal wire members 20*b* set at the base of the circle 10 are thicker in diameter. Two of the horizontal wire members 2a set in the center part of the wire lattice body X are also thicker in diameter. In the embodiment, the diameter of the horizontal wire members 2 are 3.6 mm and the diameter of the horizontal wire members 2a, 20a, 20b are 4.5 mm. These the horizontal wire members 2a, 20a, 20b having the thicker diameter develop the strength of the wire lattice body X, especially the strength against the force applying at the right angle of the plane face of the wire lattice body X. The horizontal wire members 20b set at the base of the circle 10 is important factor to keep the strength of the circle 10. It is preferable to use the thicker horizontal wire member at the base of the circle 10, except the condition where the upper end of the circle 10** is fixed at the base thereof as describing later.

Figure 3:
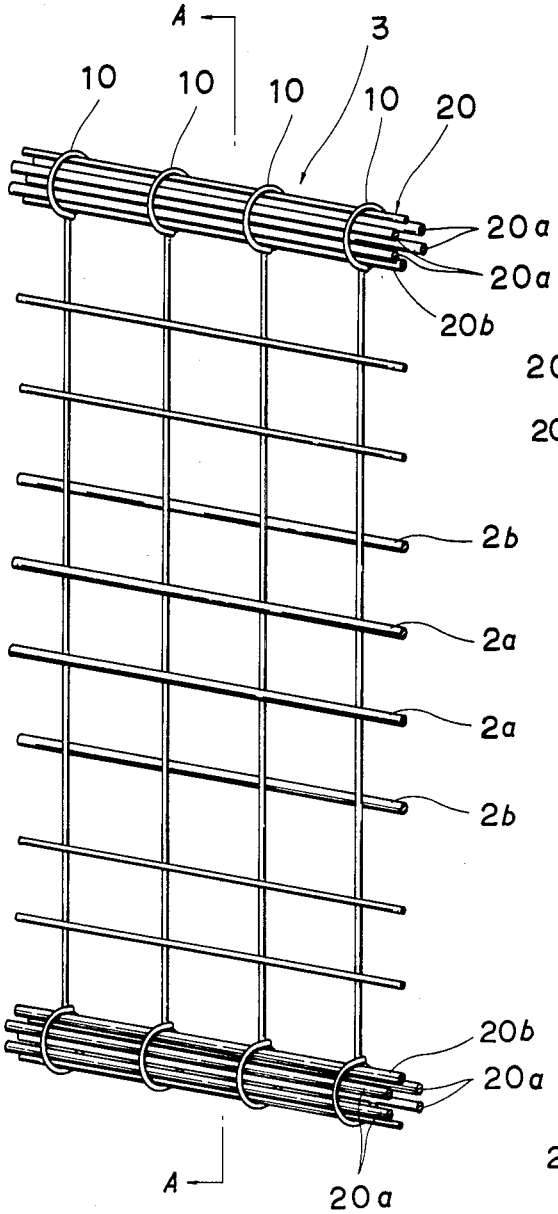
FIG. 3 is a perspective view showing another embodiment of the inventive wire latticework.
Figure 4:
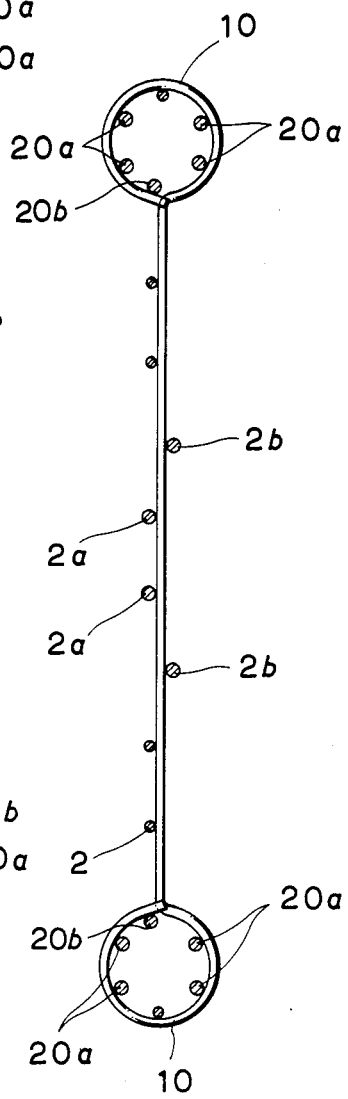
FIG. 4 is a cross sectional view seen from A—A line in FIG. 3.

FIG. 3 and 4 show the embodiment of the taller the wire lattice body X. Two of the horizontal wire members 2a having thicker diameter are fixed at the center portion of the wire lattice body X and also two of the horizontal wire members 2b with thicker diameter are set at the back side of the wire lattice body X, which can further develop the strength of the wire lattice body X.

Figure 5:
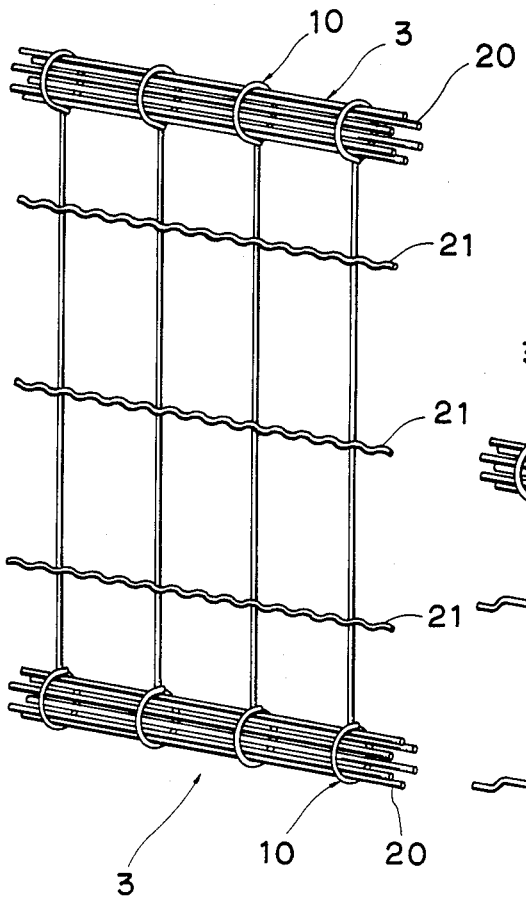
FIG. 5 is a perspective view showing another embodiment of the wire latticework of the invention.
Figure 6:
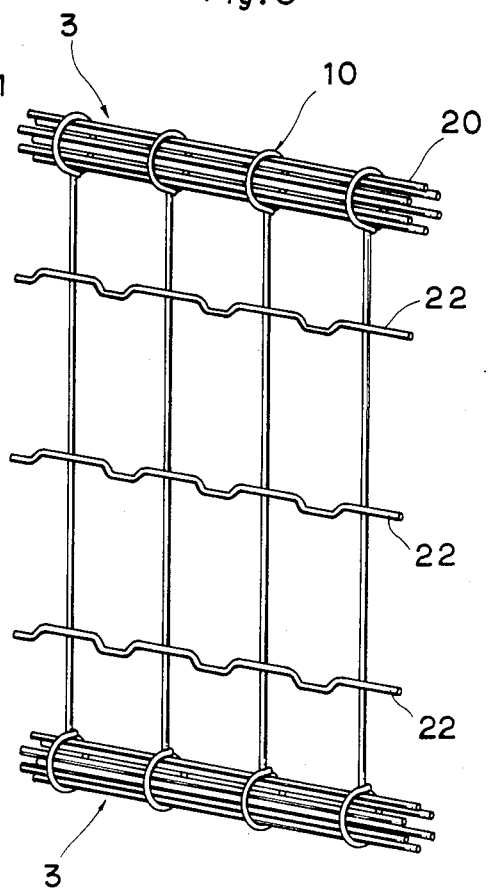
FIG. 6 is a perspective view of another embodiment of the wire latticework of the invention
Figure 7A:
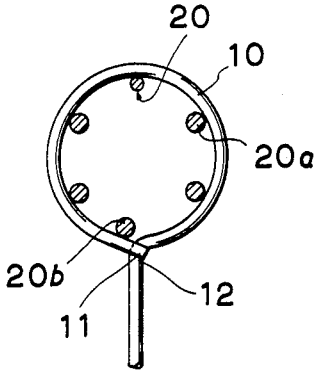
FIGS. 7A, 7B, 7C, 7D, 7E, 7F, are partially enlarged views showing various examples of the circles formed at the end of the vertical wire members.
Figure 7B:
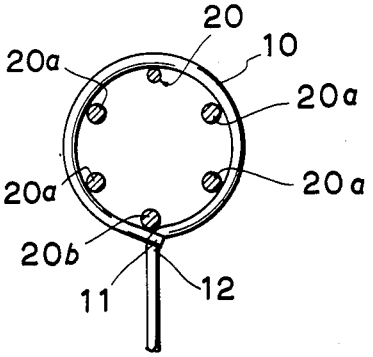
Figure 7C:
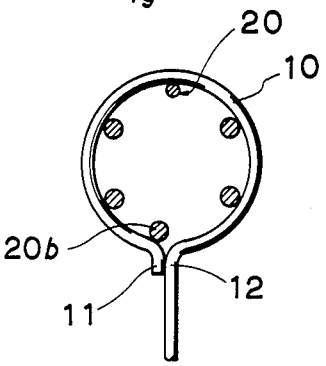
Figure 7D:
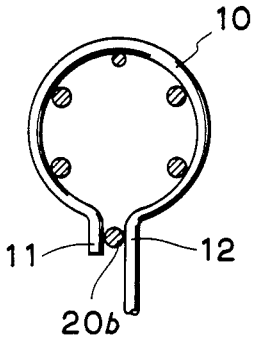
Figure 7E:
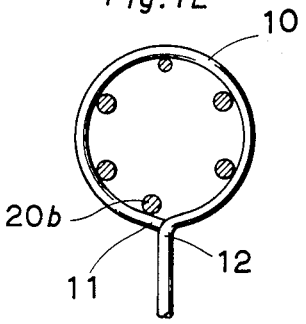
Figure 7F:
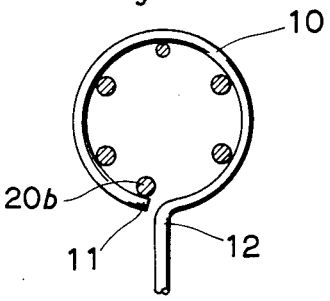

The horizontal wire members may be non-straight in the present invention. FIG. 5 shows the wire lattice body X where all of the horizontal wire members at the plane part of the wire lattice body X are wave form horizontal wire members 21. In FIG. 6, the horizontal wire members 22 at the plane part of the wire lattice body X has convex potions arranged with some separation. Such non-straight horizontal wire members absorb the deformation force applied thereto. These non-straight horizontal wire members may be thicker in diameter per se or may be used with the horizontal wire members 2 of the thicker diameter. Further the non-straight horizontal wire members can be used in the cylindrical part 3.

FIG. 7 shows various examples of the circle 10. FIG. 7F shows the circle 10 where the top 11 of the circle 10 is disconnected with the base 12 thereof. In order to strengthen the circle 10 and the cylindrical part 3, it is preferable to fix the top 11 to the circle 10 by welding or the like as shown in FIG. 7A. FIG. 7B shows the embodiment of the circle 10 where the top 11 and the base 12 abut and welded each other and further the horizontal wire members 20b is so set as to abut the top 11 and the base 12 and welded to them. Such construction further strengthen the circle 10 than the construction of FIG. 7A. In FIG. 7C the top 11 extends downwardly and abuts and is welded to the straight part of the base of the circle 10. FIG. 7D shows the circle 10 where the horizontal wire members 20b is set and fixed between the top 11 extended downwardly and the straight part of the base of the circle 10. In FIG. 7E the end face of the top 11 contacts to the circle 10 and is fixed by the welding or the like.

In these construction of the circle 10 shown in FIGS. 7A–7E, the circle 10 becomes stronger because the circle 10 is the closed circle structure.

Figure 8:
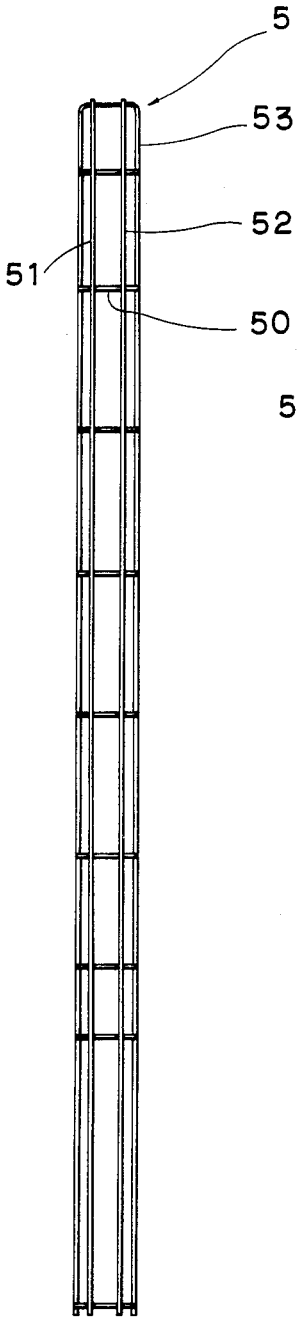
FIG. 8 is a front view showing one example of the inventive support.
Figure 9:
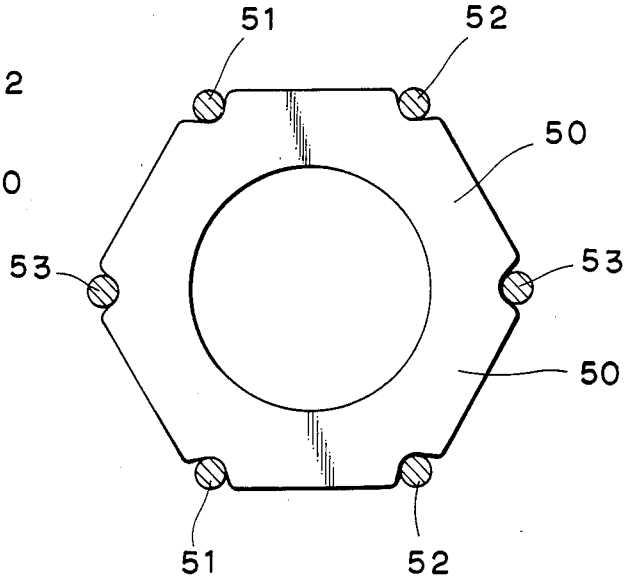
FIG. 9 is a plan view of the plate.

FIGS. 8 and 9 show the inventive support used in the inventive fence combining the above the wire lattice body X and the support.

the support 5 of this invention comprises wire members and plates. the plates 5 of hexagonal shape having a hole at the center thereof hold and support the vertical wire members 51, 52, 53 at the each corner as shown in FIG. 9. The plurality of the plate 50 (9 plates in FIG. 9) is arranged in vertical direction. The vertical wire members 51, 52, 53 join the plurality of the plate 50 and form the pipe shape entirely. Each of the vertical wire members 51, 52, 53 is bent in U-shape at the top. the vertical wire members 51 and 52 are parallel therewith. The top of the vertical wire members 53 intersects under the tops of the vertical wire members 51 and 52 at right angle.

The number and diameter of the wire members, the shape and number of the plates are not limited by the embodiment. They may be arbitrary depending on the condition, the specification or the like.

Such inventive support is light in weight and receives less wind pressure or less snow weight, which develop the whole strength of the fence. Since the prior support made of the pipe need to form some holes thereon to join with the wire lattice body X, there is disadvantages that the assembling work with the wire lattice body X is not easy and the support is subject to corrode by water invaded from the holes. Since the inventive support does not need holes to join with the wire lattice body X as describing later, the work for assembling is easy and the support is resistant against such corrosion. Further the combination of the support and the wire lattice body X improve the outlooking of the fence and provide the harmonizing view, because both of the support and the wire lattice body X are made of the wire members.

Figure 10:
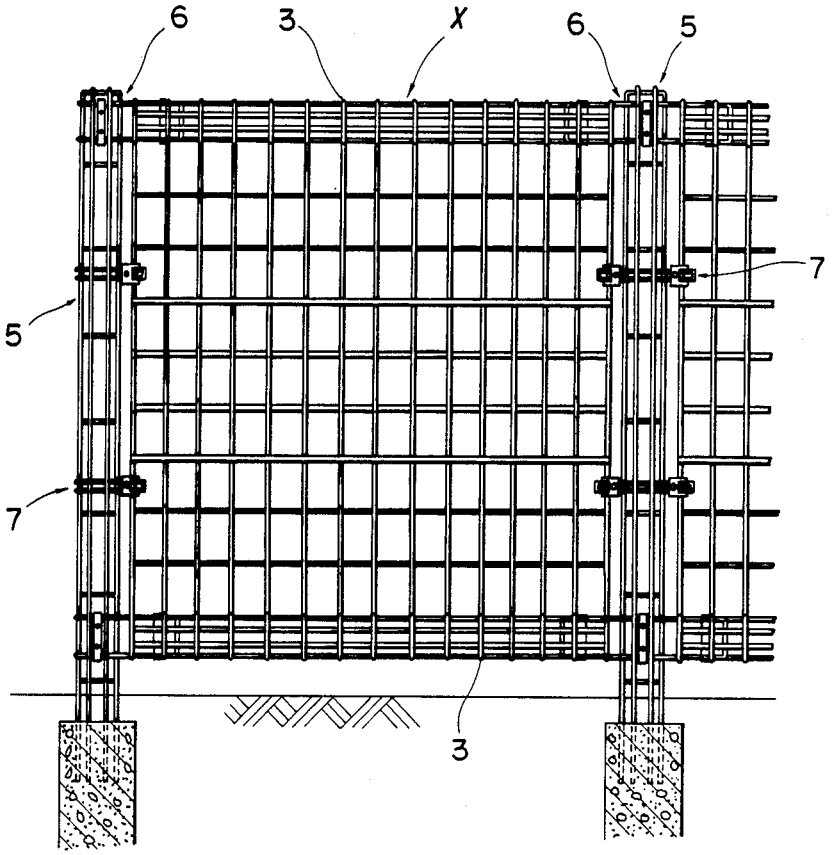
FIG. 10 is a front view showing one example of the inventive fence.
Figure 11:
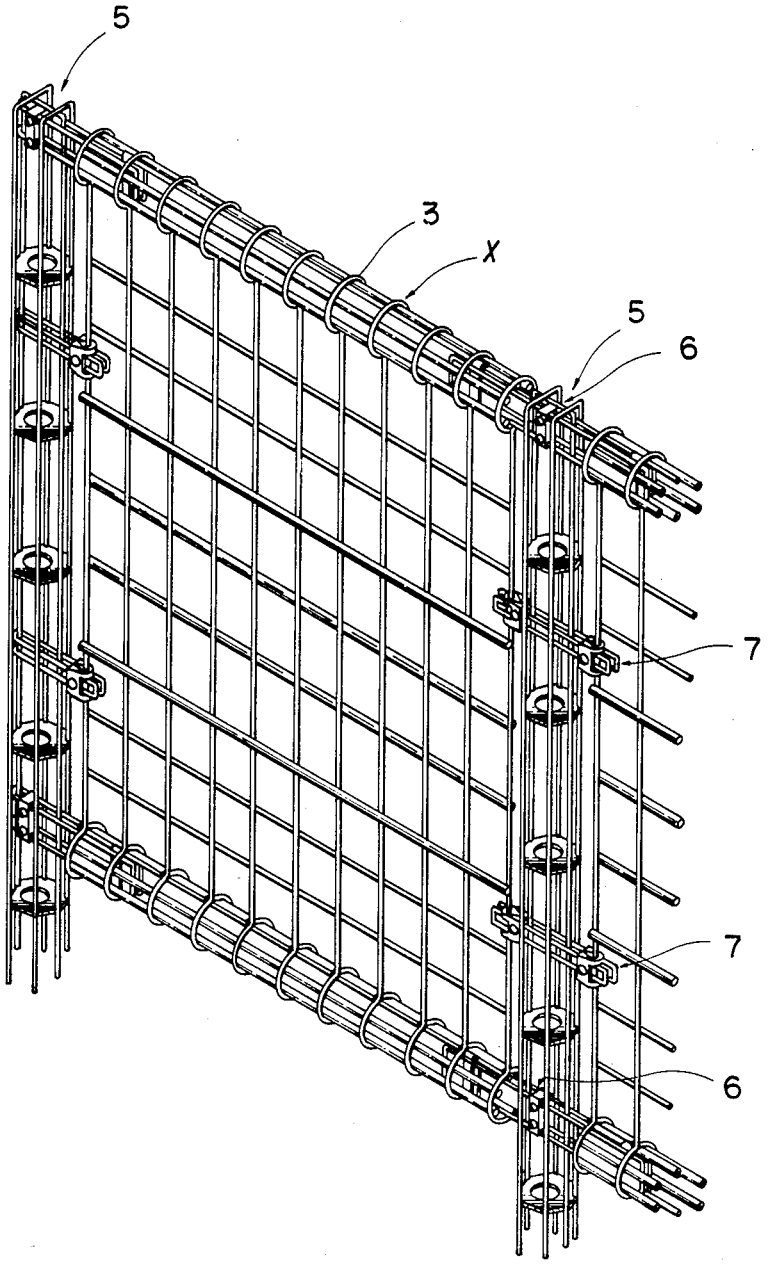
FIG. 11 is a perspective view showing the example of the fence

FIGS. 10 and 11 show the embodiment of the fence using the inventive support. Though the latticework in FIGS. 10 and 11 include the horizontal wire members having the thicker diameter, the inventive fence is not so limited as such construction. The fence may employ the latticework having the horizontal wire members of the same diameter, having nonstraight the horizontal wire members, and also having the prior pipe beam.

The embodiment employing the combination of the inventive support and the inventive latticework provide the unified outlooking as clearly shown in FIGS. 10, 11 because the whole of fence is made of the wire members. Such fence receives less wind pressure and snow weight, the strength thereof developes. The fence is also lighter in weight, may save the materials and costs for the production because of being made of the wire members.

More important advantage of such fence of the present invention combining the inventive support and the latticework is to simplify the joining work and the joint for the support and the lattice work. When using the conventional support made of a pipe, the structure of joint for the support and the latticework is very complex as shown U.S Pat. No. 455,885 because the size of the diameter between the wire member of the latticework and the pipe of the support is quite different. In the present invention, it is possible to join the wire members of the lattice work and the support because the support is composed by the wire members. Thus the invention can make the joint simple and make the work for joining easy.

Figure 12A:
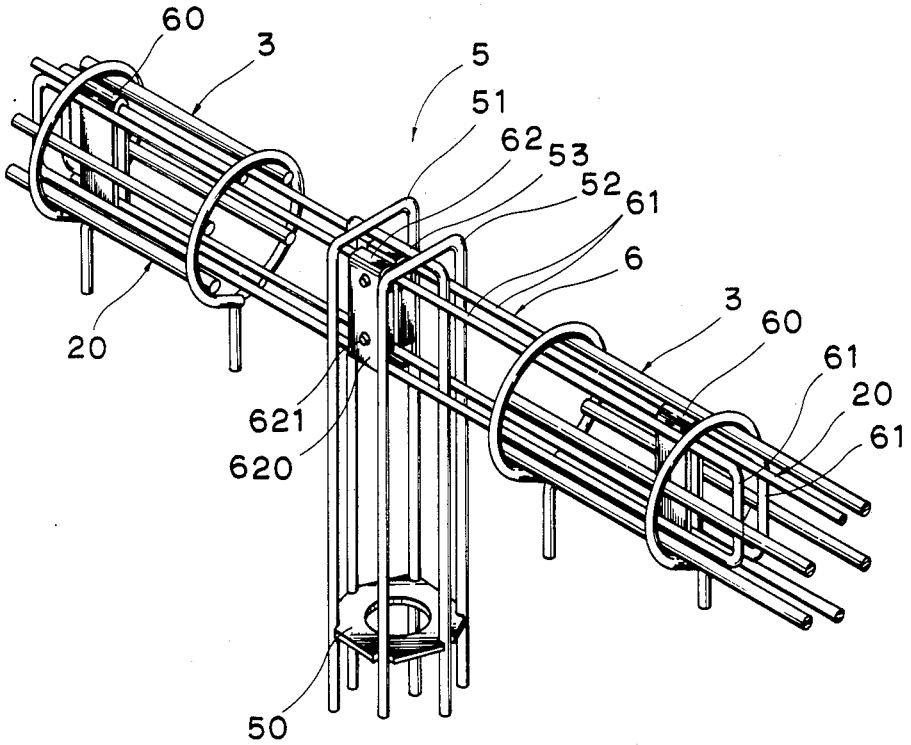
FIG. 12A, 12B, 12C are perspective views showing connecting means for cylindrical part.

The embodiment of FIGS. 10, 11 show that the wire lattice body X is joined with the support 5 at the cylindrical part 3 and the plane part of the wire lattice body X by the connecting joint 6 and the connecting joint 7 respectively. The structure of joining the wire lattice body X with the support 5 at the cylindrical part 3 is shown in FIG. 12A. The pair of the upper and lower wire members among the horizontal wire members 20 of each the cylindrical part 3 set both sides of the support 5 are provided with the spacer 60 bent in U-shape.

The pair of the rectangular wire ring 61 is so incorporated in both of the cylindrical part 3 through the support 5 as to catch the spacer 60 and the vertical wire members 53 of the support 5 therein. The spacer 60 is fastened at the center of the support 5 by the seat plate 62 to fix the spacer 60 and the vertical wire members 53 therebetween. the seat plate 62 is consists of the pair of the plates 620 which puts the rectangular wire ring 61 therein and the bolt & nut 621 fastening the plates 620.

Figure 12B:
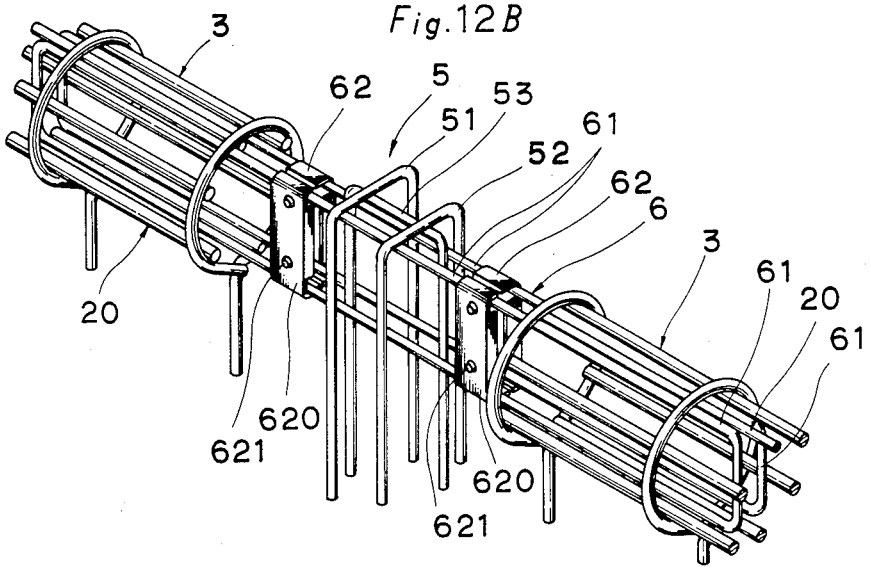
Figure 12C:
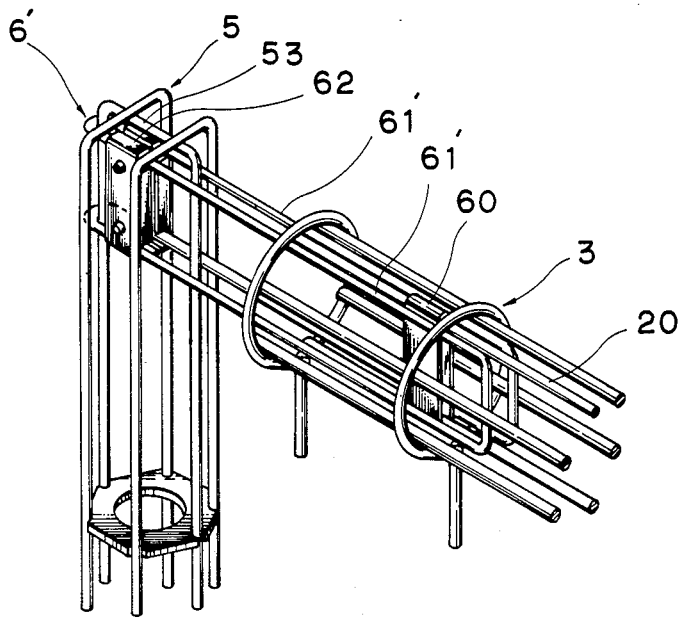
Figure 13A:
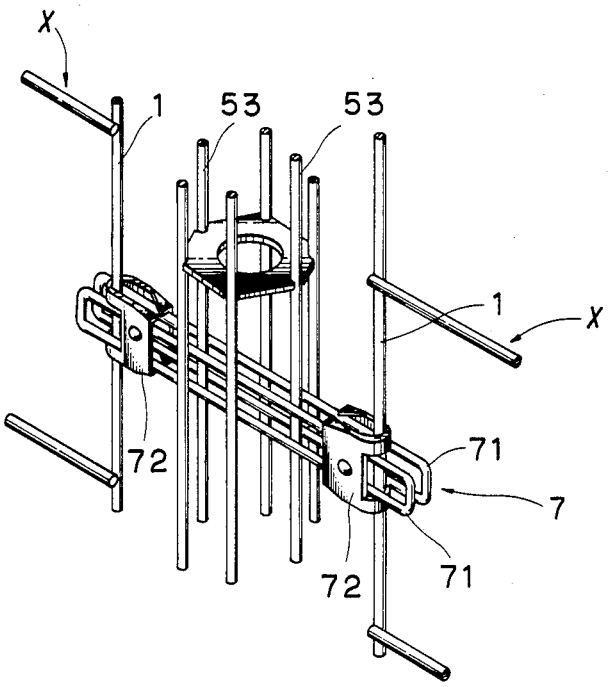
FIG. 13A, 13B are perspective views showing connecting means for plane part.
Figure 13B:
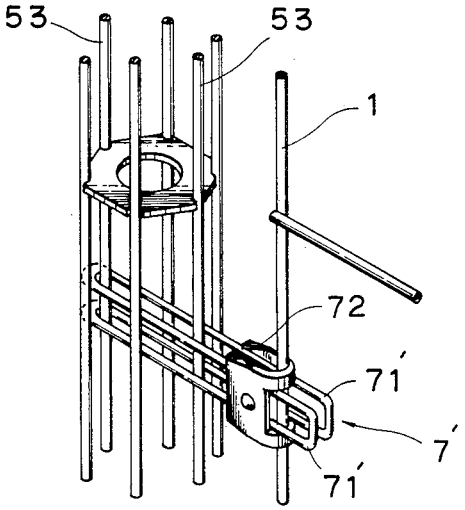

FIG. 12B shows the joining structure where the spacer 60 is not utilized. In the embodiment, the pair of the rectangular wire ring 61 put directly the upper and lower horizontal wire members 20 therein and the pair of the seat plate 62 is preferably employed at the both sides of the support 5 in order to increase the fastening force. FIG. 12C indicates the structure of the connecting joint 6' at the end of the fence, where the pair of the rectangular wire ring 61' bent in U-shape at the center portion is so inserted in the support 5 and the cylindrical part 3 as to catch the vertical wire members 53 and the spacer 60 between the U-shape. The connecting joint 6' is tightened by the seat plates the seat plate 62. FIG. 13A indicates the connecting joint 7 for joining the straight part of the vertical wire members 1 of the wire lattice body X and the support 5. The pair of the rectangular wire ring 71 of the connecting joint 7 put the vertical wire members 53, 53 of the support 5 and the vertical wire members 1 of the wire lattice body X directly without the spacer 60. And the seat plate 72, 72 tighten the rectangular wire ring 71, 71 respectively. The seat plate 72 is the same as one in U.S. Pat. No. 4,558,851, but any other constructions may be employed as the seat plate 72. In FIG. 13B, the connecting joint 7' at the end of the fence includes the rectangular wire ring 71' bent in U-shape which catches the vertical wire members 53, 53 of the support 5 and the straight part of the vertical wire members 1 of the wire lattice body X.

Figure 14:
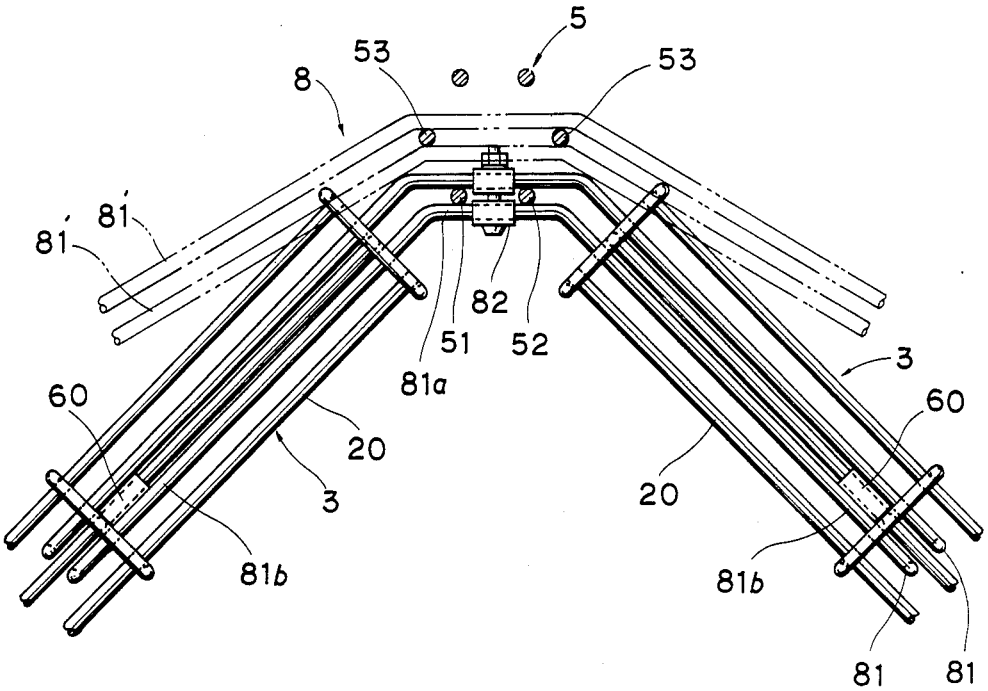
FIG. 14 is a plan view of a connecting means for corner of the fence.

The embodiment of the joining construction at the corner of the fence is indicated in FIG. 14. The connecting joint 8 is also consists of the rectangular wire ring 81, 81 and the seat plate 82. The rectangular wire ring 81 is bent leaving the center part **81*a* at the both ends to make the predetermined angle (90 degree in the figure) between the side part 81*b* and 81*b*. The center part 81*a* of the pair of the rectangular wire ring 81 catch the vertical wire members 51, 52 of the support 5 therebetween, the side part 81*b*, 81*b* put in the spacer 60 set at the upper and lower one among the horizontal wire members 20 of the cylindrical part 3 of the wire lattice body X respectively. The pair of the rectangular wire ring 81 is tightened in the support 5 by the seat plate 82. When the angle of the corner is wider than 90 degree, the side part 81*b*, 81*b* take the responding angle as shown at line ( approximately 135 degree ), and catch in and tighten the vertical wire members 53, 53 of the support 5. In order to set the extending line of the axial center of the cylindrical part 3 around the center of the support 5, it is necessary to change the vertical wire members to be caught by the center part 81*a*** responding to the angle of the corner of the fence.

I claim:

1. A wire latticework for a fence including a plurality of horizontal wire members and vertical wire members, wherein circular portions are formed each on at least the upper ends of said vertical wire members, a group of horizontal members are arranged within the circular portions and connected thereto so as to form a cylindrical part, some of the horizontal wire members within said cylindrical part or on the other part of the latticework are thicker in diameter than the rest of said horizontal wire members.

2. A wire latticework for a fence as defined in claim 1, wherein circular portions are formed on the upper and lower ends of the vertical wire members, a group of horizontal members are arranged within the circular potions and connected thereto so as to form a cylindrical parts at the upper and lower ends of the latticework.

3. A wire latticework for a fence as defined in claim 1, wherein the horizontal wire members set at the center part of the latticework and at the both sides of the circular portion are thicker in diameter than the rest of the horizontal wire members.

4. A wire latticework for a fence as defined in claim 1, wherein the horizontal wire members are arranged at both sides of the latticework and connected thereto.

5. A wire latticework for a fence including a plurality of horizontal wire members and vertical wire members, wherein circular portions are formed each on at least the upper ends of said vertical wire members, a group of horizontal members are arranged within the circular potions and connected thereto so as to form a cylindrical part, at least some of the horizontal wire members are bent.

6. A wire latticework for a fence as defined in claim 5, wherein all of the horizontal wire members except ones arranged within the cylindrical part are bent.

7. A wire latticework for a fence as defined in claim 5, wherein said bent horizontal wire members are in the shape of a wave.

8. A wire latticework for a fence as defined in claim 5, wherein said bent horizontal wire members include convex portions arranged with some separation.

9. A wire latticework for a fence including a plurality of horizontal wire members and vertical wire members arranged to form a wire lattice body having a plane part, wherein at least the upper ends of said vertical wire members are bent in a circle the sectional center of which is on the line produced from the plane part of said wire lattice body and the respective top edges of the upper ends abut to the respective bases of the circles and connected thereto, a group of horizontal members are arranged within the circles and connected thereto so as to form a cylindrical part.

10. A wire latticework for a fence as defined in claim 9, wherein the top edges abut at the side of the base of the circle and are connected thereto.

11. A wire latticework for a fence as defined in claim 9, wherein a horizontal wire member is arranged within the cylindrical part so as to abut both of the top edges and the bases of the vertical wire members and connected to said top edges and said bases.

12. A wire latticework for a fence as defined in claim 9, wherein the top edges extends downwardly and abut the straight parts of the bases of the circles and are connected thereto.

13. A wire latticework for a fence including a plurality of horizontal wire members and vertical wire members arranged to form a wire lattice body having a plane part, wherein at least the upper ends of said vertical wire members are bent in a circle the sectional center of which is on the line produced from the plane part of said wire lattice body and the respective top edges of the upper ends are connected to the respective bases of the circles, a group of horizontal members are arranged within the circles and connected thereto so as to form a cylindrical part, wherein the top edges extend downwardly adjacent to the straight parts of the bases of the circles, and one horizontal wire member is arranged and fixed between the top edges extending downwardly and the straight parts of the bases of the circles.

14. A wire latticework for a fence as defined in claim 9, wherein the edge faces of said top edges abut said bases of the circles and are connected thereto.

15. A wire latticework for a fence including a plurality of horizontal wire members and vertical wire members, wherein at least the upper ends of said vertical wire members are bent in a circle and the respective top edges of the upper ends abut to the respective bases of the circles and connected thereto, a group of horizontal members are arranged within the circles and connected thereto so as to form a cylindrical part, and some of said horizontal wire members are thicker in diameter than the rest of said horizontal wire members.

16. A fence of wire latticework comprising;

A wire lattice body including a plurality of horizontal wire members and vertical wire members, wherein circular portions are formed each on at least the upper ends of said vertical wire members, a group of horizontal members are arranged within the circular potions and connected thereto so as to form a cylindrical part;

the support comprising a plurality of plates arranged with some separation in vertical direction, a plurality of vertical wire members being arranged around the circumference of the plates and connected thereto so as to join the plurality of the plates and form the support shape entirely;

a joining means which join said wire lattice body to said support.

17. A fence of wire latticework as defined in claim 16, wherein the cylindrical part is formed at the lower end of the lattice body too.

18. A fence of wire latticework as defined in claim 16, comprising the joining means including;

a spacer in U-shape which receives the pair of the upper and lower horizontal wire members within the cylindrical part therebetween;

a grip means which grips the spacer and some of the vertical wire members of the support;

a fix means which fix the grip means so as to join the spacer and some of the vertical wire members of the support.

19. A fence of wire latticework as defined in claim 16, comprising the joining means including;

a grip means which grips at least one of the vertical wire members of the lattice body and at least one of the vertical wiremembers of the support;

a fix means which fix the grip means so as to join the vertical wire members.

20. A fence of wire latticework comprising;

A wire lattice body including a plurality of horizontal wire members and vertical wire members, wherein at least the upper ends of said vertical wire members are bent in a circle and the respective top edges of the upper ends abut to the respective bases of the circles and connected thereto, a group of horizontal members are arranged within the circles and connected thereto so as to form a cylindrical part;

a support including a plurality of plates arranged with some separation in vertical direction, a plurality of vertical wire members being arranged around the circumference of the plates and connected thereto so as to join the plurality of the plates and form a support shape entirely;

a joining means which join said wire lattice body to said support.

21. A fence as defined in claim 20, wherein some of the horizontal wire members of the lattice body are thicker in diameter than the rest of said horizontal wire members.

22. A fence as defined in claim 20, wherein some or all of the horizontal wire members of the lattice body are bent.

* * * * *